US007652439B2

(12) United States Patent
Tang

(10) Patent No.: US 7,652,439 B2
(45) Date of Patent: Jan. 26, 2010

(54) CHANGEOVER DEVICE OF PULL CORD CONTROL AND WIRELESS REMOTE CONTROL FOR A DC BRUSHLESS-MOTOR CEILING FAN

(75) Inventor: Yung Yu Tang, Taichung (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 152 days.

(21) Appl. No.: 11/834,771

(22) Filed: Aug. 7, 2007

(65) Prior Publication Data

US 2009/0039805 A1 Feb. 12, 2009

(51) Int. Cl.
*B23Q 35/00* (2006.01)

(52) U.S. Cl. ..... 318/162; 318/51; 318/256; 318/280

(58) Field of Classification Search ..... 318/162, 318/51, 256, 16, 280, 257, 490, 480, 603; 417/44.1; 388/819
See application file for complete search history.

(56) References Cited

U.S. PATENT DOCUMENTS 5,738,496 A * 4/1998 Mehta ..... 417/44.1
2006/0044154 A1* 3/2006 Liao ..... 340/825.72

* cited by examiner

*Primary Examiner*—Karen Masih
(74) *Attorney, Agent, or Firm*—Ming Chow; Sinorica, LLC

(57) ABSTRACT

A change-over device of pull cord control and wireless remote control for a DC brushless-motor ceiling fan is to have a driver installed in a ceiling fan basic body, and the driver has a detecting unit for detecting whether or not a connector positioned in a hanging bell is connected with a wireless control switch unit so as to control the blades of the DC brushless-motor ceiling fan to rotate by pull cord control or by wireless remote control. Further, the connector is installed inside the hanging bell; therefore, when the DC brushless-motor ceiling fan is to be additionally provided with a wireless control switch unit, it is convenient and safe in installation.

6 Claims, 5 Drawing Sheets

CHANGEOVER DEVICE OF PULL CORD CONTROL AND WIRELESS REMOTE CONTROL FOR A DC BRUSHLESS-MOTOR CEILING FAN

BACKGROUND OF THE INVENTION

1. Field of the Invention

This invention relates to a changeover device, particularly to one used for changing over pull cord control and wireless remote control for a DC brushless-motor ceiling fan.

2. Description of the Prior Art

A conventional ceiling fan, as shown in FIG. 1, includes a basic body 1 positioned at a free end of the ceiling fan. The basic body 1 of the ceiling fan has one end connected with an extension tube 2 pivotally disposed inside a hanging bell 3 at a fixed end of the ceiling fan. The basic body 1 of the ceiling fan is provided in the interior with a controller 4 and a driving motor 5, and the controller 4 has one end connected with a pull cord-controlled switch 6 for operating the controller 4 to drive the driving motor 5 to turn the ceiling fan blades 7 that are pivotally fixed on the driving motor 5.

However, the conventional ceiling fan is to have the pull cord-controlled switch 6 to turn on or off the controller 4 to drive the driving motor 5 to and turn the ceiling fan blades 7 for producing wind velocity. If the conventional ceiling fan is to be additionally provided with a remote-controlled switch for use, the ceiling fan has to be disassembled first so as to let the controller 4 removed from the ceiling fan basic body 1. Subsequently, fittings of the remote-controlled switch are secured on the controller 4 and then, the controller 4 and the ceiling fan can be assembled anew, thus resulting in much inconvenience, wasting labor and time and increasing danger caused by improper re-installation of the ceiling fan.

SUMMARY OF THE INVENTION

The objective of this invention is to offer a changeover device of pull cord control and wireless remote control for a DC brushless-motor ceiling fan, mainly including a driver and a connector. The driver positioned in the interior of a ceiling fan basic body is provided with a detecting unit for detecting whether or not the connector inside a hanging bell is connected with a wireless-controlled switch unit. When detecting that the connector is already connected with the wireless-controlled switch unit, the detecting unit will send back a control signal to a micro-processor and at this time, the micro-processor will only receive control signals coming from a wireless remote-controlled unit instead of receiving control signals coming from a pull cord controlled unit. Further, the connector is installed inside the hanging bell; therefore, when the DC brushless-motor ceiling fan is expected to have a function of remote control, it is only necessary to have a wireless-controlled switch unit assembled inside the hanging bell and connected with the connector therein, facilitating installation and avoiding danger caused by improper assembly.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
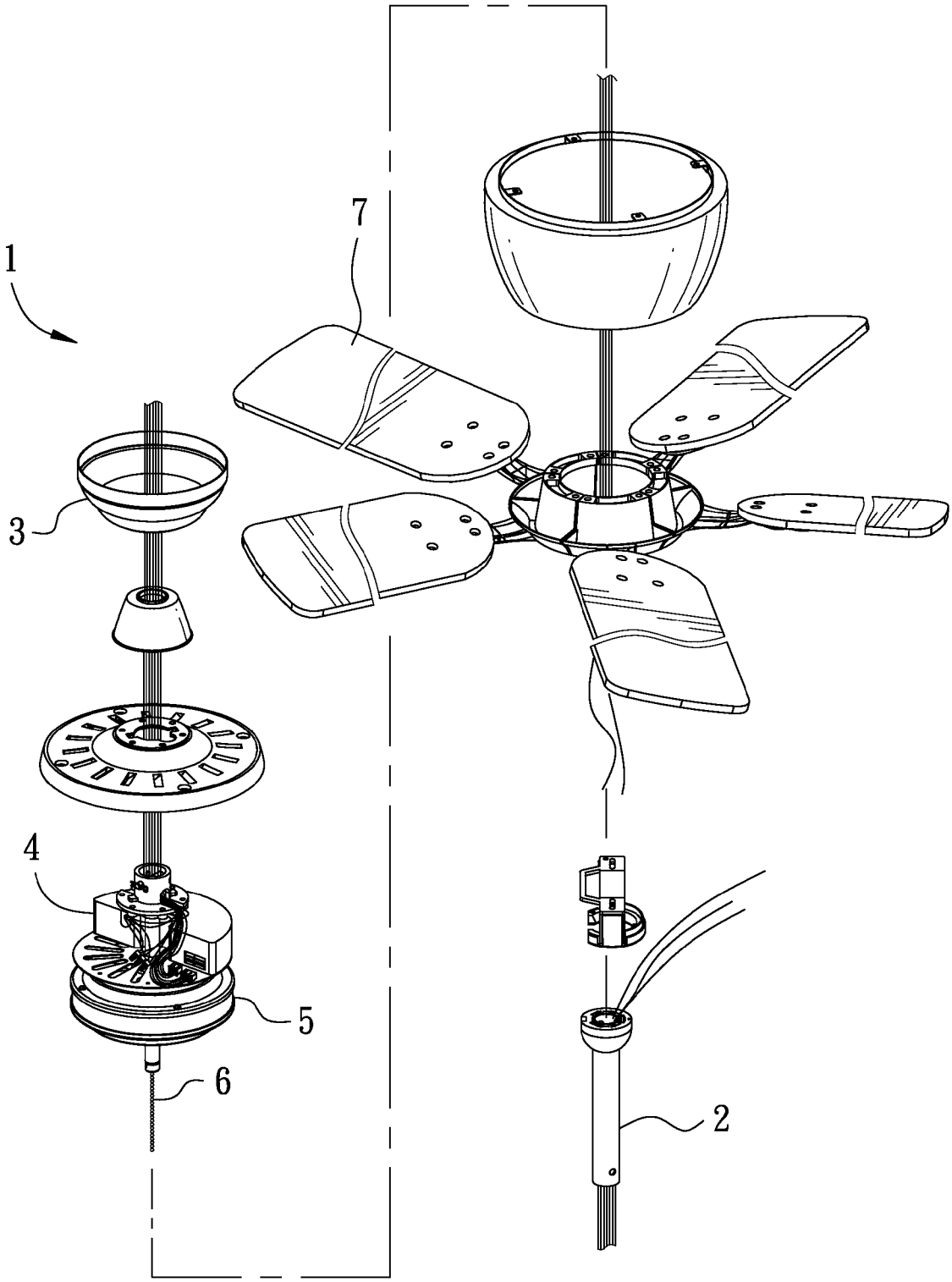
FIG. 1 PRIOR ART
FIG. 1 is an exploded perspective view of a conventional ceiling fan.
Figure 2:
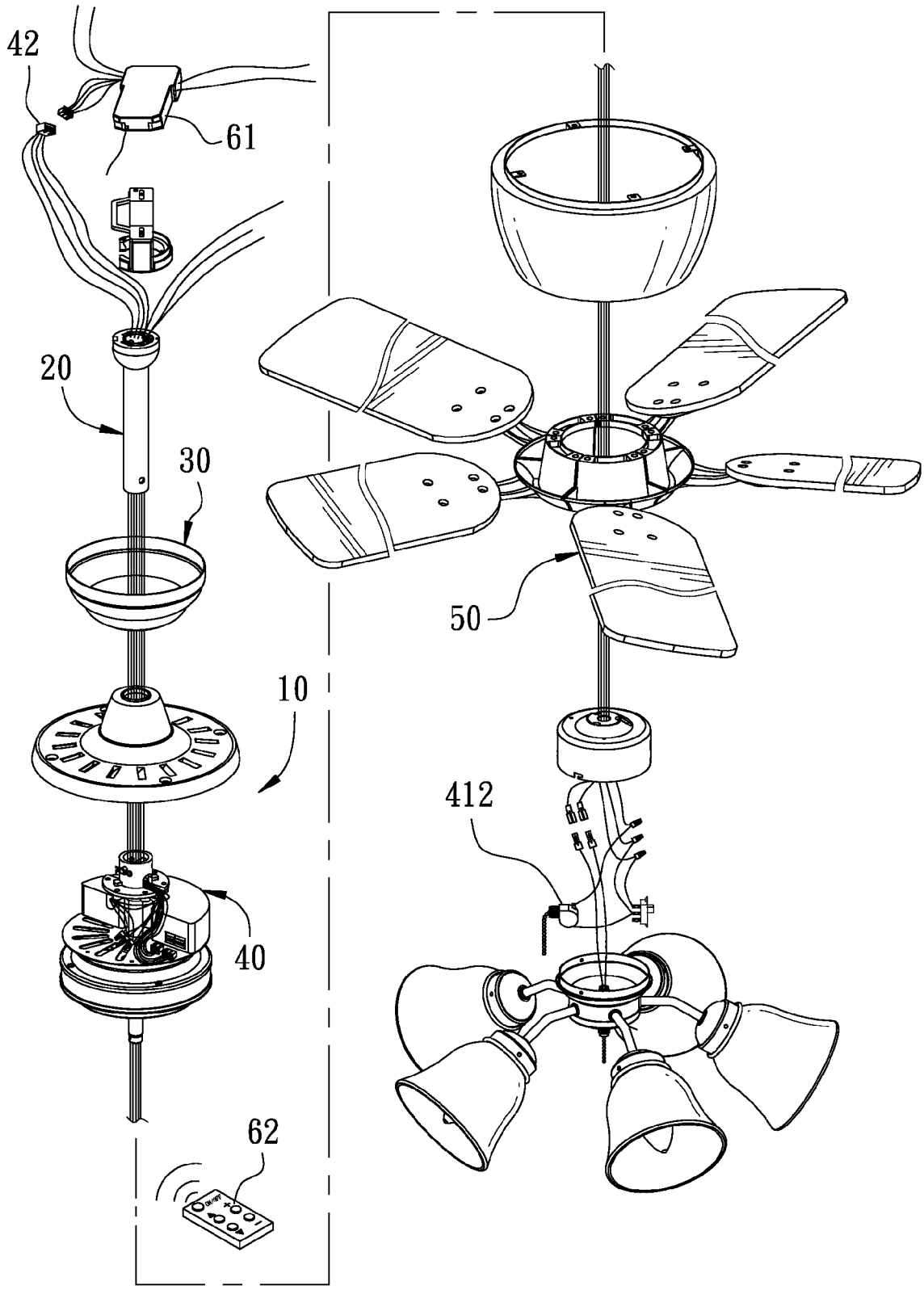
FIG. 2 is an exploded perspective view of a first preferred embodiment of a D.C. brushless-motor ceiling fan in the present invention.
Figure 3:
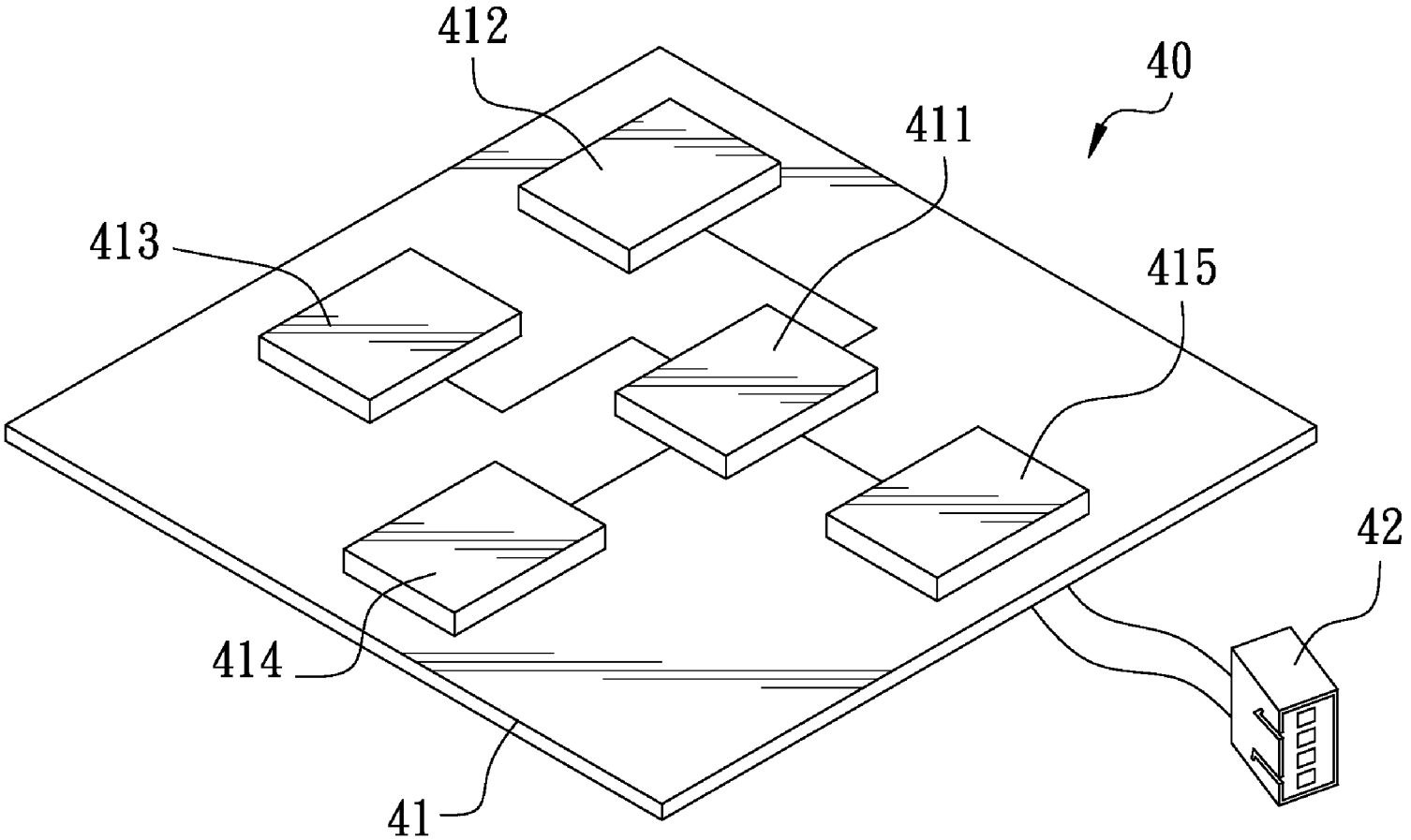
FIG. 3 is a block diagram of the first preferred embodiment of a changeover device of pull rope control and wireless remote control for a DC brushless-motor ceiling fan in the present invention.

A first preferred embodiment of a change-over device of pull cord control and wireless remote control for a DC brushless-motor ceiling fan in the present invention, as shown in FIG. 2, includes a ceiling fan basic body 10 positioned at a free end of a DC brushless-motor ceiling fan. The ceiling fan basic body 10 has one end connected with an extension tube 20 pivotally disposed in a hanging bell 30 at a fixed end of the DC brushless-motor ceiling fan. The changeover device 40 of pull rope control and wireless remote control consists of a driver 41 and a connector 42.

Figure 4:
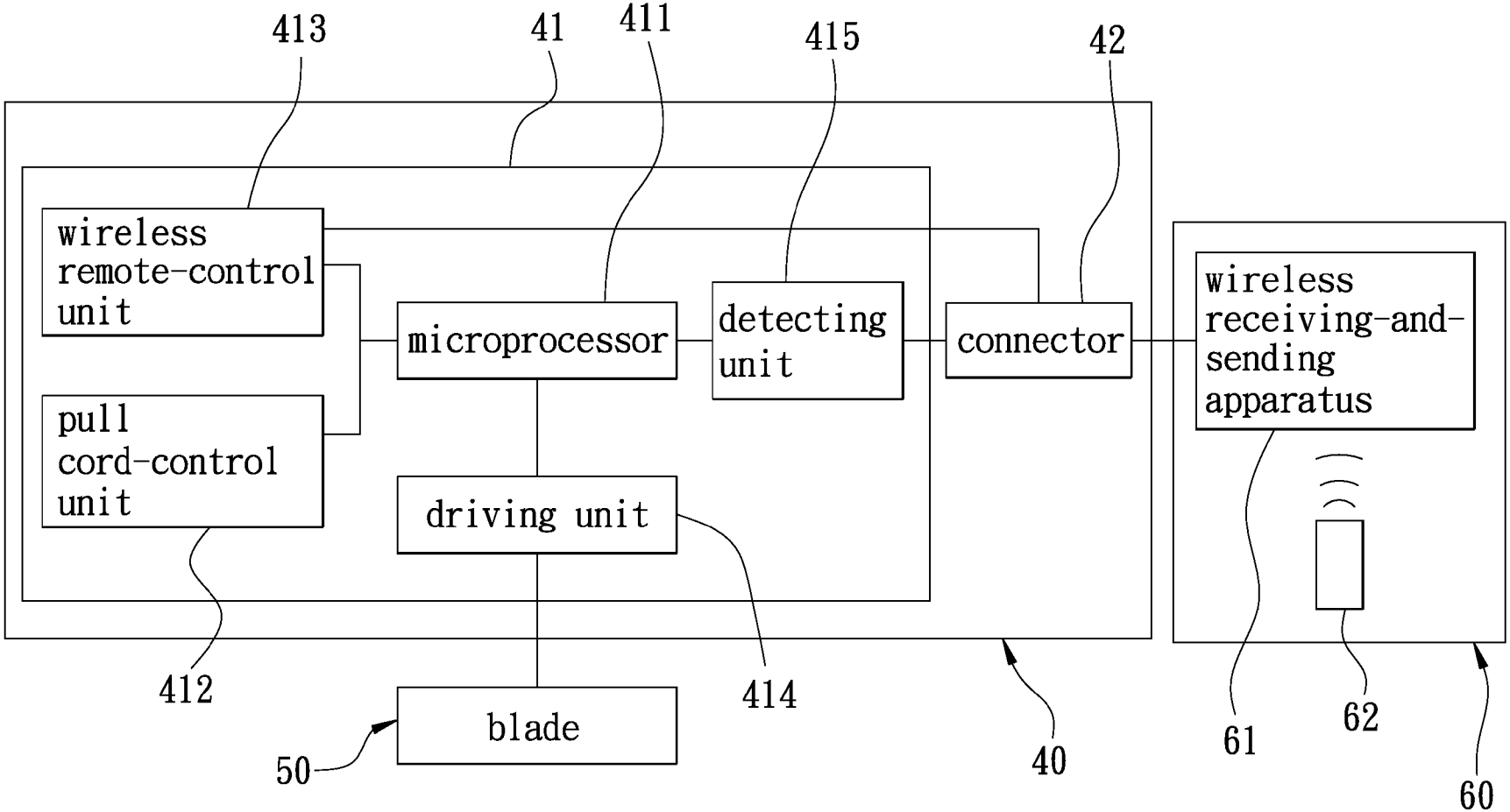
FIG. 4 is a block diagram of the first preferred embodiment of the change-over device in the present invention.

The driver 41 installed in the interior of the ceiling fan basic body 10 is composed of a microprocessor 411, a pull cord-control unit 412, a wireless remote-control unit 413, a driving unit 414 and a detecting unit 415 on a printed circuit board. The microprocessor receives, processes, operates and chooses control signals received by one end and coming from the pull cord-control unit 412, or coming from the wireless remote-control unit 413. Referring to FIG. 4, the microprocessor 411 has the other end connected with the driving unit 414 for driving the ceiling fan blades fixed with the other end of the driving unit 414 to rotate. The micro-processor 411 is further connected with the detecting unit 415 for detecting whether or not the DC brushless-motor ceiling fan is connected with a wireless-controlled switch unit 60 and sending back a control signal to the micro-processor 411.

The connector 42 received in the interior of the hanging bell 30 has one end connected with the detecting unit 415 and the wireless remote-control unit 413 of the driver 41, and the other end connected with a wireless receiving-and-sending apparatus 61 of the wireless-controlled switch unit 60, with the wireless receiving-and-sending apparatus 61 receiving control signals transmitted by a wireless controller 62.

In using, referring to FIG. 4, when the detecting unit 415 of the driver 41 detects that the connector 42 is not yet connected with the wireless-control switch unit 60, the micro-processor 411 of the DC brushless-motor ceiling fan will only receive the control signal input by the pull cord-controlled unit 412 to let the blades 50 of the DC brushless-motor ceiling fan controlled to rotate merely by the pull cord-controlled unit 412, which is a pull cord controller in this preferred embodiment. Referring to FIG. 2, when the DC brushless-motor ceiling fan is to be provided with a wireless-controlled switch unit 60, only remove the hanging bell 30 downward and connect the wireless receiving-and-sending apparatus 61 of the wireless-control switch unit 60 with the connector 42. In this preferred embodiment, the connector 42 and the wireless receiving-and-sending apparatus 61 are fitted with each other for producing electric coupling. At this time, the detecting unit 415 will detect that the connector 42 is already connected with the wireless receiving-and-sending apparatus 61 and send a control signal to the micro-processor 411, and after receiving and processing the control signal, the micro-processor 411 is set to receive only the control signal input by the wireless remote-controlled unit 413. Thus, a user can use the wireless controller 62 to control the wireless remote-control unit 413 for turning the blades 50 of the DC brushless-motor ceiling fan, and at this time the signal input by the pull cord-control unit 412 to the microprocessor 411 becomes invalid.

Figure 5:
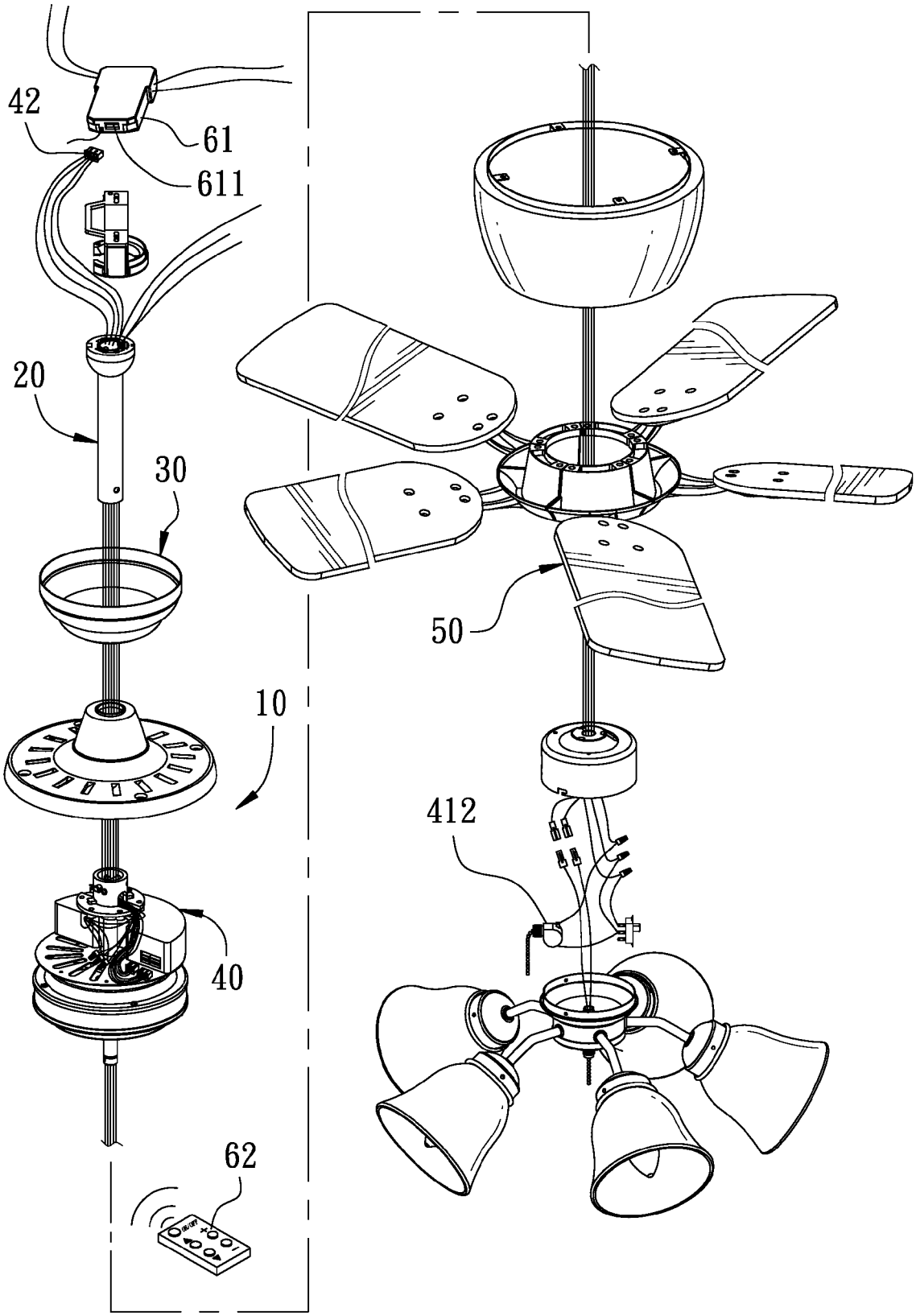
FIG. 5 is an exploded perspective view of a second preferred embodiment of a DC brushless-motor ceiling fan in the present invention.

A second preferred embodiment of a change-over device of pull cord control and wireless remote control for a DC brushless-motor ceiling fan, as shown in FIG. 5, has the same structure and function as those described in the first preferred embodiment, except that the wireless receiving-and-sending apparatus 61 of the wireless-controlled switch unit 60 has one side cut with an insert notch 611 for one end of the connector 42 inserted therein.

While the preferred embodiment of the invention has been described above, it will be recognized and understood that various modifications may be made therein and the appended claims are intended to cover all such modifications that may fall within the spirit and scope of the invention.

I claim:

1. A DC brushless-motor ceiling fan comprises, a ceiling fan body being positioned at a free end of said DC brushless-motor ceiling fan;

a hanging bell being pivotally positioned at a fixed end of said DC brushless-motor ceiling fan;

a change over device for pull-cord control and wireless remote control;

said change-over device comprising:

a driver being installed inside said ceiling fan body;

said driver being provided with a micro-processor on a printed circuit board;

said micro-processor having a first end being connected with a pull cord-control unit and a wireless remote-control unit, a second end being connected with a driving unit; and a third end being connected with a detecting unit;

a connector being disposed inside said hanging bell;

said connector having a first end being connected with said detecting unit and said wireless remote-control unit;

said connector having a second end being connected with a wireless control switch unit; and the detecting unit detects a status of connection between the connector and the wireless control switch unit.

2. The DC brushless-motor ceiling fan as claimed in claim 1, wherein said pull cord control unit is a pull cord control switch.

3. The DC brushless motor ceiling fan as claimed in claim 1, wherein said connector has another end connected with a wireless control switch unit;

said detecting unit sends a control signal to said micro-processor when the connector and the wireless control switch unit are connected.

4. The DC brushless-motor ceiling fan as claimed in claim 3, wherein said micro-processor only receives control signals of said wireless remote control unit.

5. The DC brushless-motor ceiling fan as claimed in claim 3, wherein said connector having a third end electrically fitted with a wireless receiving-and-sending apparatus of said wireless control switch unit.

6. The DC brushless-motor ceiling fan as claimed in claim 3, wherein said connector having a fourth end being directly inserted in an insert notch of said wireless receiving-and-sending apparatus of said wireless control switch unit.

* * * * *